US005820637A

United States Patent [19]

Bory et al.

[11] Patent Number: 5,820,637

[45] **Date of Patent: *Oct. 13, 1998**

[54] METHOD OF PRETREATING STAINED FABRICS WITH PRETREATER OR LAUNDRY ADDITIVE COMPOSITIONS CONTAINING HYDROPHOBICALLY MODIFIED POLAR POLYMERS

[75] Inventors: Barbara Helen Bory, Fort Lee; Dennis Stephen Murphy, Leonia; Tamara Padron; Lucia Victoria Salas, both of North Bergen, all of N.J.

[73] Assignee: Lever Brothers Company, Division of Conopco, Inc., New York, N.Y.

[ * ] Notice: The term of this patent shall not extend beyond the expiration date of Pat. No. 5,747,442.

[21] Appl. No.: 591,790

[22] Filed: Jan. 25, 1996

[51] Int. Cl.[6] ..... B08B 3/08; C11D 3/37

[52] U.S. Cl. ..... 8/137; 510/283; 510/284; 510/475; 510/476

[58] Field of Search ..... 510/283, 284, 510/475, 476, 477; 8/137

[56] References Cited

U.S. PATENT DOCUMENTS

| | | | |
|---|---|---|---|
| 3,869,399 | 3/1975 | Collins | 510/284 |
| 4,147,649 | 4/1979 | Arnau et al. | 510/284 |
| 4,260,528 | 4/1981 | Fox et al. | 510/223 |
| 4,465,619 | 8/1984 | Boskamp | 510/405 |
| 4,472,297 | 9/1984 | Bolich, Jr. et al. | 510/121 |
| 4,491,539 | 1/1985 | Hoskins et al. | 510/426 |
| 4,543,205 | 9/1985 | Contamin | 510/136 |
| 4,556,510 | 12/1985 | Holsopple | 510/159 |
| 4,576,744 | 3/1986 | Edwards et al. | 510/426 |
| 4,617,148 | 10/1986 | Shields | 510/138 |
| 4,678,606 | 7/1987 | Akhter et al. | 510/159 |
| 4,738,792 | 4/1988 | Ertle | 510/284 |
| 4,759,868 | 7/1988 | Clarke | 510/421 |
| 4,786,439 | 11/1988 | Ploog et al. | 252/8.63 |
| 4,788,006 | 11/1988 | Bolich, Jr. et al. | 510/121 |
| 4,877,546 | 10/1989 | Lai | 510/428 |
| 4,927,563 | 5/1990 | McCall | 424/702 |
| 4,992,194 | 2/1991 | Liberati et al. | 510/303 |
| 5,073,285 | 12/1991 | Liberati et al. | 510/375 |
| 5,126,066 | 6/1992 | Torenbeek et al. | 252/186.26 |
| 5,147,576 | 9/1992 | Montague et al. | 510/417 |
| 5,190,693 | 3/1993 | Mattioli et al. | 252/313.1 |
| 5,232,632 | 8/1993 | Woo et al. | 510/406 |
| 5,254,284 | 10/1993 | Barone et al. | 510/181 |
| 5,264,142 | 11/1993 | Hessel et al. | 510/303 |
| 5,268,003 | 12/1993 | Coope et al. | 8/111 |
| 5,281,355 | 1/1994 | Tsaur et al. | 510/393 |
| 5,281,357 | 1/1994 | Morgan et al. | 510/393 |
| 5,286,405 | 2/1994 | Rennie et al. | 510/397 |
| 5,308,530 | 5/1994 | Aronson et al. | 510/393 |
| 5,336,430 | 8/1994 | Bahary et al. | 510/222 |
| 5,366,654 | 11/1994 | Van Den Brom et al. | 134/25.2 |
| 5,419,848 | 5/1995 | VanEenam | 510/365 |

FOREIGN PATENT DOCUMENTS 0471410 2/1992 European Pat. Off. .

OTHER PUBLICATIONS

National Starch & Chemical Speciality Polymers Division, "Novel applications for water–soluble, hydrophobically–modified polymers in fabric wash detergents," Hodgetts et al. No date available.

National Starch & Chemical Limited Speciality Polymers, "Speciality Polymers NARLEX H1200". No date available.

*Primary Examiner*—Paul Lieberman
*Assistant Examiner*—Lorna M. Douyon
*Attorney, Agent, or Firm*—Matthew Boxer

[57] ABSTRACT

A pretreater or laundry additive composition which removes stains and as a laundry additive, whiten fabrics are described herein. The compositions contain 0.1 to 20 wt. % of a nonionic surfactant, 0.1% to 10 wt. % of a hydrophobically modified polymer and less than about 5 wt. % of an anionic soap. Methods of using the composition are also described.

10 Claims, No Drawings

METHOD OF PRETREATING STAINED FABRICS WITH PRETREATER OR LAUNDRY ADDITIVE COMPOSITIONS CONTAINING HYDROPHOBICALLY MODIFIED POLAR POLYMERS

FIELD OF THE INVENTION

This invention relates to a pretreater or an in-wash laundry additive composition in either a liquid or gel form which contains a hydrophobically modified polar polymer and nonionic surfactants. The compositions may also be used as laundry additives to boost whitening effects and improve stain removal in the wash.

BACKGROUND OF THE INVENTION

Prewash stain remover compositions for the laundry have been in use for many years. Recently developed pretreater compositions available in liquid, spray and gel forms are usually based on nonionic surfactants. The consumer applies the stain remover to the soiled portions of the garments before washing with a laundry detergent. The ingredients in the prewash stain remover or in-wash whitener/stain remover work to remove stains, but either high levels of costly ingredients are required or a plateau in stain removal is observed with increasing concentration of the ingredient. It has been found that inclusion of hydrophobically modified polar polymers helps to significantly enhance the stain removal performance of the prewash stain remover. Similar compositions may also be used as in wash laundry additives to boost whitening effects and improve stain removal. It has been found that such formulations containing hydrophobically modified polar polymers when used in conjunction with a detergent significantly boosts whitening and improve stain removal.

Deflocculating polymers which allow incorporation of more surfactants and/or electrolytes in a detergent composition are described in U.S. Pat. No. 5,147,576 issued to Montague.

The polymers of the Montague reference comprise a hydrophilic backbone which is generally a linear branched or highly cross-linked molecular composition containing one or more types of hydrophilic monomer units; and hydrophobic side chains, for example, selected from the group consisting of siloxanes, saturated or unsaturated alkyl and hydrophobic alkoxy groups, aryl and alkylarlyl groups, and mixtures thereof.

These polymers were not, however, taught for use in pretreater or in-wash laundry boosting compositions which are designed for direct application to stains or for boosting the performance of detergents, respectively, and require compositions which are significantly different from detergents. These compositions are preferably based on nonionic aqueous solutions.

Although U.S. Pat. No. 5,308,530 does teach the use of these polymers in detergent formulas there is no suggestion or discussion that such combinations would provide improved pretreater or laundry additive compositions.

Thus, there still exists a need in the art for a stable pretreater compositions based on non-ionic surfactants and hydrophobically modified polar polymers for improved cleaning performance on stains.

It is therefore an object of the present invention to provide an aqueous laundry stain pretreater composition which provides outstanding cleaning performance on a variety of stains for a variety of fabrics.

Another object of the invention is to provide an aqueous nonionic based composition which boosts the fluorescer whitening of detergents without added fluorescer and improves stain removal.

SUMMARY OF THE INVENTION

The compositions of the invention achieve these and other objects of the invention and contain from about 0.1 to about 10% by wt. of a hydrophobically modified polar polymer which has a hydrophilic backbone (hydrophilic backbone made of one monomer only, e.g., acrylate) wherein there is a critical molar ratio of hydrophilic groups (e.g., the backbone) to hydrophobic "anchors" attached ("tail") to the backbone and about 0.1 to about 20% of a nonionic surfactant.

Enzymes and an enzyme stabilizing system are optionally incorporated into the composition for improved cleaning.

The compositions of the invention provide improved stain removal by the pretreater composition prior to the laundry wash. When used as an in wash additive, they also provide enhanced fluorescer effectiveness and stain removal.

DETAILED DESCRIPTION OF PREFERRED EMBODIMENTS

The present invention relates to compositions which may be used as either pretreaters in liquid, gel or spray form or in-wash laundry additives. It is understood that the terms "in-wash" or "in-wash laundry booster" are interchangeable with the terms "laundry additive" or "in-wash laundry additive".

The compositions are based on nonionic surfactants and are substantially free of anionic surfactants.

When the polymers of the invention are added to the specific compositions, it has been unexpectedly found that the compositions have better stain removal efficacy compared to compositions which do not contain the polymers.

Hydrophobically Modified Polar Polymer

The polymer of the invention is one which, as noted above, has previously been used in structured (i.e., lamellar) compositions such as those described in U.S. Pat. No. 5,147,576 to Montague et al., hereby incorporated by reference into the subject application.

In general, the polymer comprises a "backbone" component which is a monomer (single monomer) as discussed below and a "tail" portion which is a second monomer which is hydrophobic in nature (e.g., lauryl methacrylate or styrene).

The hydrophilic backbone generally is a linear, branched or highly cross-linked molecular composition containing one type of relatively hydrophobic monomer unit wherein the monomer is preferably sufficiently soluble to form at least a 1% by weight solution when dissolved in water. The only limitation to the structure of the hydrophilic backbone is that a polymer corresponding to the hydrophilic backbone made from the backbone monomeric constituents is relatively water soluble (solubility in water at ambient temperature and at pH of 3.0 to 12.5 is preferably more than 1 g/l). The hydrophilic backbone is also preferably predominantly linear, e.g., the main chain of backbone constitutes at least 50% by weight, preferably more than 75%, most preferably more than 90% by weight.

The hydrophilic backbone is composed of one monomer unit selected from a variety of units available for polymer preparation and linked by any chemical links including:

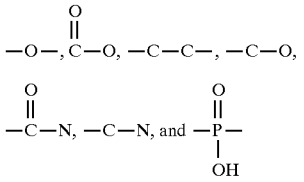

(I)

The "tail" group comprises a monomer unit comprising hydrophobic side chains which are incorporated in the "tail" monomer. The polymer is made by copolymerizing hydrophobic monomers (tail group comprising hydrophobic groups) and the hydrophilic monomer making up the backbone. The hydrophobic side chains preferably include those which when isolated from their linkage are relatively water insoluble, i.e., preferably less than 1 g/l, more preferred less than 0.5 g/l, most preferred less than 0.1 g/l of the hydrophobic monomers, will dissolve in water at ambient temperature at pH of 3.0 to 12.5.

Preferably, the hydrophobic moieties are selected from siloxanes, saturated and unsaturated alkyl chains, e.g., having from 5 to 24 carbons, preferably 6 to 18, most preferred 8 to 16 carbons, and are optionally bonded to hydrophilic backbone via an alkoxylene or polyalkoxylene linkage, for example a polyethoxy, polypropoxy, or butyloxy (or mixtures of the same) linkage having from 1 to 50 alkoxylene groups. Alternatively, the hydrophobic side chain can be composed of relatively hydrophobic alkoxy groups, for example, butylene oxide and/or propylene oxide, in the absence of alkyl or alkenyl groups.

Monomer units which make up the hydrophilic backbone include:

(1) unsaturated, preferably mono-unsaturated, $C_{1-6}$ acids, ethers, alcohols, aldehydes, ketones or esters such as monomers of acrylic acid, methacrylic acid, maleic acid, vinyl-methyl ether, vinyl sulphonate or vinyl alcohol obtained by hydrolysis of vinyl acetate, acrolein;

(2) cyclic units, unsaturated or comprising other groups capable of forming inter-monomer linkages, such as saccharides and glucosides, alkoxy units and maleic anhydride;

(3) glycerol or other saturated polyalcohols.

Monomeric units comprising both the hydrophilic backbone and hydrophobic side chain may be substituted with groups such as amino, amine, amide, sulphonate, sulphate, phosphonate, phosphate, hydroxy, carboxyl and oxide groups.

The hydrophilic backbone is composed of one unit. The backbone may also contain small amounts of relatively hydrophilic units such as those derived from polymers having a solubility of less than 1 g/l in water provided the overall solubility of the polymer meets the requirements discussed above. Examples include polyvinyl acetate or polymethyl methacrylate.

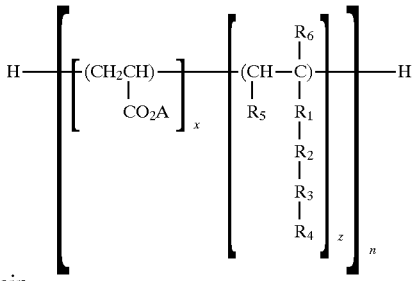

(II)

wherein z is 1;

x:z (i.e., hydrophilic backbone to hydrophobic tail) is less than 20, preferably less than 17, more preferably less than 10;

in which the monomer units may be in random order; and n is at least 1:

$R_1$ represents —CO—O—, —O—, —O—CO—, —$CH_2$—, —CO—NH— or is absent;

$R_2$ represents from 1 to 50 independently selected alkyleneoxy groups preferably ethylene oxide or propylene oxide groups, or is absent, provided that when $R_3$ is absent and $R_4$ represents hydrogen or contains no more than 4 carbon atoms, then $R_2$ must contain an alkyleneoxy group with at least 3 carbon atoms;

$R_3$ represents a phenylene linkage, or is absent;

$R_4$ represents hydrogen or a $C_{1-24}$ alkyl or $C_{2-24}$ alkenyl group, with the provisos a) when $R_1$ represents —O—CO—, $R_2$ and $R_3$ must be absent and $R_4$ must contain at least 5 carbon atoms;

b) when $R_2$ is absent, $R_4$ is not hydrogen and when $R_3$ is absent, then $R_4$ must contain at least 5 carbon atoms;

$R_5$ represents hydrogen or a group of formula —COOA;

$R_6$ represents hydrogen or C1–4 alkyl; and A is independently selected from hydrogen, alkali metals, alkaline earth metals, ammonium and amine bases and $C_{1-4}$.

Alternatively, the group such as,

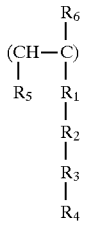

group (defined by z) can be substituted with benzene, for example styrene.

The present invention is direct to the observation that, when polymers such as those described above (known as deflocculating or decoupling polymers in the "structured liquid" art) are used in pretreater or laundry additive booster formulations they provide enhanced stain removal and, when used in the wash with a detergent containing fluorescer, they enhance the fluorescer whitening.

The polymer should be used in an amount comprising 0.01 to 10% by wt., preferably 0.1% to 5% by wt. of the composition.

Nonionic Surfactants

The nonionic surfactants useful in the present invention are those compounds produced by the condensation of alkylene oxide groups with an organic hydrophobic material which may be aliphatic or alkyl or aromatic in nature. The link of the hydrophilic or polyoxyalkylene radical which is condensed with any particular hydrophobic group can be readily adjusted to yield a water soluble compound having the desired degree of balance between hydrophilic and hydrophobic elements. Illustrative, but not limiting examples, of various suitable non-ionic surfactant types are:

(a) polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol. Particularly preferred non-ionic surfactant compounds in this category are the "Neodol" type products, a registered trademark of the Shell Chemical Company.

Also included within this category are nonionic surfactants having a formula:

$$R-(\underset{\underset{R^1}{|}}{CH_2CHO})_x(CH_2CH_2)_y(\underset{\underset{R^2}{|}}{CH_2CHO})_zH \quad \text{(II)}$$

wherein R is a linear alkyl hydrocarbon radical having an average of 6 to 18 carbon atoms, $R^1$ and $R^2$ are each linear alkyl hydrocarbons of about 1 to about 4 carbon atoms, x is an integer of from 1 to 6, y is an integer of from 4 to 20 and z is an integer from 4 to 25.

A preferred nonionic surfactant included within this category are compounds of formula:

$$R^3-(CH_2CH_2O)_aH \quad \text{(III)}$$

wherein $R^3$ is a $C_6$–$C_{24}$ linear or branched alkyl hydrocarbon radical and a is a number from 2 to 50; more preferably $R^3$ is a $C_8$–$C_{18}$ linear alkyl mixture and a is a number from 2 to 15.

(b) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

(c) polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbitan monostearate, sorbitan monoisostearate, sorbital tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di- or tri-acid esters.

(e) polyoxyethylene-polyoxypropylene block copolymers having formula:

$$HO(CH_2CH_2O)_a(CH(CH_3)CH_2O)_b(CH_2CH_2O)_cH \quad \text{(IV)}$$

or $$HO(CH(CH_3)CH_2O)_d(CH_2CH_2O)_e(CHCH_3CH_2O)_fH \quad \text{(V)}$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

(f) Alkyl glycosides having formula:

$$R^4O(R^5O)_n(Z^1)_p \quad \text{(VI)}$$

wherein $R^4$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^5$ is a divalent hydrocarbon radical containing from 2 to about 4 carbon atoms such as ethylene, propylene or butylene (most preferably the unit $(R^5O)_n$ represents repeating units of ethylene oxide, propylene oxide and/or random or block combinations thereof; n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG® 300, 325 and 350 with $R^4$ being $C_9$–$C_{11}$, n is 0 and p is 1.3, 1.6 and 1.8–2.2 respectively; APG® 500 and 550 with $R^4$ is $C_{12}$–$C_{13}$, n is 0 and p is 1.3 and 1.8–2.2, respectively; and APG® 600 with $R^4$ being $C_{12}$–$C_{14}$, n is 0 and p is 1.3. Particularly preferred is APG® 600.

The nonionic surfactant which are most preferred are the polyoxyalkylene condensates of paragraphs "(a)" and "(b)" and the alkyl glycosides. Most preferred are the polyoxyalkylene condensates.

The nonionic is used in an amount of about 0.1 to about 20 wt. %.

Optional Polymers

Conventional Polymers also referred to as antiredeposition polymers may also be incorporated in the formulations of the invention. Such polymers include polycarboxylates (e.g. copolymers of acrylate/maleate commercially available as Sokolan® copolymers supplied by BASF; polyoxyalkylene copolymers (e.g. Pluronic Series supplied by BASF); carboxymethylcelluloses (e.g. CMC Series supplied by Union Carbide); methylcellulose (e.g. Methocel from Dow Chemical) and ethoxylated polyamines (e.g. ethoxylated tetra ethylene pentamine from Shell Chemical Co). Especially preferred are the polycarboxylate polymers. The polymers should be incorporated in the formulations of the invention in an amount of up to about 5 wt. %, preferably 0.1 wt. % to 3 wt. %, most preferably 0.5 wt. % to 1 wt. %.

Anionic Soaps

The pretreater formulations of the invention do not contain anionic surfactants. It is possible, however, to add less from about 5 wt. %, preferably less than 3 wt. % of an anionic soap may be included in some in wash formulations to boost whitening of fabrics. Any such anionic soaps should be derived carboxylic acids including "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

Enzymes

Enzymes may optionally be included in the pretreater or in wash formulations to enhance the removal of soils from fabrics. If present, the enzymes are in an amount of from about 0 to 10 weight %, preferably 1 to about 5 wt. %. Such enzymes include proteases (e.g. Alcalase®, Savinase® and Esperase® from Novo Industries A/S), amylases (e.g. Termamyl® from Novo Industries A/S), lipolases (e.g. Lipolase® from Novo Industries A/S) and cellulases, (e.g. Celluzyme® from Novo Industries A/S).

Enzyme Stabilizing System

Stabilizers or stabilizer systems may be used in conjunction with enzymes and generally comprise from about 1 to 15% by weight of the composition.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate.

A small amount of calcium ion, generally from about 0.05 to about 2.5 millimoles per liter, is often also present in the composition due to calcium in the enzyme slurry and formula water.

Another enzyme stabilizer which may be used is propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propanediol which is preferred), ethylene glycol, glycerol, sorbitol, mannitol and glucose. The polyol generally represents from about 0.5% to about 15%, preferably from about 1.0% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g. sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One especially preferred stabilization system is a polyol in combination with boric acid. Preferably, the weight ratio of polyol to boric acid added is at least 1, more preferably at least about 1.3.

Preparation of Formulations

The formulations of the invention may be prepared in any form known in the art such as liquid, spray or gel. The compositions should be prepared by conventional formulation methods such as those described in U.S. Pat. No. 5,186,856, particularly directed to an aqueous form, herein incorporated by reference.

In general, aqueous formulations are prepared by mixing the nonionic and selected polymers together and heating the mixture to a temperature of up to 160° F. The mixture is then cooled and the enzymes and enzyme stabilizing system may be added. Optional ingredients, such as preservatives, dyes and perfumes are added to the cooled mixtures. The compositions are then packaged and stored.

Thickeners

Thickeners may be incorporated into the formulations of the invention. Such thickeners include, but are not limited to natural thickeners such as xanthan gums and other conventional polymeric thickeners as known in the art. The thickeners may comprise up to 5% of the formulation. Preferably, 0.1 wt. % to 3 wt. %, most preferably 0.3 wt. % to 1 wt. %.

Optional Ingredients

One or more optional additives may be included in the formulations including perfumes, dyes, pigment, opacifiers, germicides, optical brighteners, anticorrosional agents and preservatives. Each additive incorporated in the composition should be present in an amount of up to about 0.5% by wt.

The following examples will serve to distinguish this invention from the prior art and illustrate its embodiments more fully. Unless otherwise indicated, all parts, percentages and proportions referred to are by weights.

EXAMPLE I

A aqueous pretreater formulation according to the invention was prepared as Sample A below. As a comparison, an aqueous pretreater formulation without the selected hydrophobically modified polymer was prepared as Sample B.

TABLE 1

| Ingredient | Samples A | Samples B |
|---|---|---|
| boric acid | 1.4 | 1.4 |
| propylene glycol | 3.0 | 3.0 |
| alcohol ethoxylate[1] | 4.7 | 4.7 |
| Narlex ® DC-1[2] | 0.5 | 0 |
| enzyme | 0.7 | 0.7 |
| xanthan gum | 0.3 | 0.3 |
| preservative | .003 | .003 |
| deionized water | to 100% | |

[1]a nonionic surfactant having 12–15 carbon atoms in the hydrophobic group and 9 EOs and supplied as Neodol 25-9 by Shell Chemical Co.

[2]a copolymer of acrylic acid and lauryl methacrylic acid supplied by National Starch and Chemical Co.

The liquid composition of the invention was made by charging a vessel with water and heating to 160° F., adding the boric acid and stirring the liquid until a clear solution was obtained. The surfactant was then added, and the heater turned off. The polymer of Sample A was then added when the solution temperature was between 120°–150° F. The enzymes were added when the solution temperature was below 120° F., then preservative was added. The pH of the formulation was then adjusted to 7.0 (±0.5).

EXAMPLE II

The stain removal performance of the inventive composition (Sample A) versus Sample B without the selected polymer was evaluated on four (4) different stains and on three types of fabric as follows.

The three types of fabrics used to evaluate the compositions were:

1) 100% cotton
2) 50%/50% polyester/cotton blend
3) double knit 100% polyester

Cloths 1 and 2 were obtained from Textile Innovators (Windsor, N.C.), and the polyester cloth 3 was obtained from Test Fabrics (Middlesex, N.J.). Prior to staining the cloths were prewashed five times with a fluorescer free detergent at 130° F. (and dried) to remove spinning oils and increase the absorbency of the cloth. Swatches were cut to 4¾"×8¾", and a 2" diameter circle inscribed in the middle.

Four different stains were used as follows:

1) Grass (1:2 gram of water by wt. blended and filtered).
2) Liquid foundation make-up
3) Cows blood
4) Mud (strained dirt mixed 1:1 with water and blended)

The stains were applied over the 2" circle on each swatch as outlined in Table 2:

TABLE 2

| | Dosage | | | |
|---|---|---|---|---|
| Stain | Cotton | Blend | Polyester | Treatment |
| grass | 8 drops (2x) | 8 drops (2x) | 1/4 tsp. | overnight |
| blood | 7 drops | 7 drops | 18 drops | overnight |
| make-up | 7 drops | 6 drops | 28 drops | overnight |
| mud | 1/8 tsp | 1/8 tsp | 1/4 tsp | overnight |

Stained clothes were treated with the liquid pretreater and washed in 17 gallons of 95° F. tap water with a commercial laundry detergent followed by a cold rinse. The cloths were then placed in a static dryer until dry. Eight replicates of each stain with each cloth were performed.

Stain removal was measured by reflectometry and color change using a Pacific Scientific Colorgard System model 5 calorimeter. The stain removal index (SRI) gives a numerical value for stain removal and is defined as:

$$SRI=100-[(L_c-L_w)^2+(a_c-a_w)^2+(b_c-b_w)^2]^{1/2}$$

Where:

L=measured lightness (reflectance) value a=measured greenness/redness value b=measured blueness/yellowness value c=clean cloth w=stained and washed cloth Results were reported as SRI index values.

Stain removal data for Samples A and B for the four stains on the three types of cloth were observed and are reported in Table 3 below:

TABLE 3

| | STAIN REMOVAL INDEX VALUE | | | | | | | | |
|---|---|---|---|---|---|---|---|---|---|
| Sample | 100% Cotton | | | 50/50 Polyester/Cotton | | | 100% Polyester | | |
| Stain | A | B | LSD[1] | A | B | LSD[1] | A | B | LSD[1] |
| Grass | 94.89 | 89.34 | 0.52 | 80.97 | 76.29 | 0.27 | 96.79 | 92.91 | 0.50 |
| Mud | 78.32 | 77.99 | 0.94 | 83.18 | 79.70 | 2.08 | 88.87 | 85.94 | 1.74 |
| Make-up | 77.65 | 75.36 | 1.03 | 84.37 | 79.33 | 2.11 | 99.28 | 99.29 | 0.05 |
| Blood | 91.01 | 90.42 | 0.23 | 94.31 | 93.96 | 0.15 | 99.00 | 98.76 | 0.16 |

[1]LSD = Least Significant Difference at 95% confidence level.

It was thus observed that the inventive Sample A was significantly more effective at stain removal than observed with Sample B which did not contain the selected polymer.

EXAMPLE III

The following gel compositions were prepared as described in Example 1.

TABLE 4

| Ingredient | Sample C | Sample D |
|---|---|---|
| boric acid | 1.4 | 1.4 |
| propylene glycol | 3.0 | 3.0 |
| alcohol ethoxylate | 14 | 14 |
| enzyme | 1.5 | 1.5 |
| xanthan gum | 0.7 | 0.7 |
| Narlex ® DC-1 | 0 | 0.5 |
| water | to 100% | |

Sample C did not contain the hydrophobically modified polymer while Sample D contained Narlex® DC-1, a copolymer of acrylic acid and lauryl methacrylic acid supplied by National Starch and Chemical Co. The cleaning performance of Sample C versus Sample D was evaluated as described in Example 2 on 2 different stains and three types of fabrics with the results presented in Table 5:

TABLE 5

| | STAIN REMOVAL INDEX VALUES | | | | | | | | |
|---|---|---|---|---|---|---|---|---|---|
| | 100% Cotton | | | 50/50 Polyester/cotton | | | 100% Polyester | | |
| Stain | C | D | LSD[1] | C | D | LSD[1] | C | D | LSD[1] |
| grass | 92.16 | 94.03 | 0.29 | 94.46 | 94.91 | 0.23 | 95.94 | 96.78 | 0.29 |
| mud | 76.71 | 78.89 | 0.91 | 79.85 | 79.94 | 1.63 | 90.09 | 92.5 | 0.85 |

[1]LSD = Least Significant Difference at 95% confidence level.

From the results described in Table 5, it was observed that the inventive formulation was significantly better in stain removal than the sample without the polymer of the invention.

EXAMPLE IV

A gel form of the inventive formulation incorporating a styrene containg acrylic acid copolymer was prepared as described in Example 1 and presented in Table 6 below:

TABLE 6

| Ingredient | % Active |
|---|---|
| boric acid | 1.4 |
| propylene glycol | 3.0 |
| alcohol ethoxylate[1] | 14 |
| enzyme | 1.5 |
| xanthan gum | 0.7 |
| ALCO EXP 2499[2] | 0.5 |
| Deionized water | to 100% |

[1]a nonionic surfactant supplied by Shell as Neodol 25-9.
[2]a styrene containing acrylic acid copolymer supplied by Alco under the Series H100.

EXAMPLE V

An aqueous composition incorporating a styrene containing acrylic acid copolymer was prepared as described in Example 1 having the formula described in Table 7:

TABLE 7

| Ingredient | % Active |
|---|---|
| boric acid | 1.4 |
| propylene glycol | 3.0 |
| alcohol ethoxylate[1] | 4.7 |
| enzyme | 0.7 |
| xanthan gum | 0.3 |
| ALCO EXP 2499[2] | 0.5 |
| Deionized water | to 100% |

[1]a nonionic surfactant supplied by Shell as Neodol 25-9.
[2]a styrene containing acrylic acid copolymer supplied by Alco under the Series H100.

EXAMPLE 6

The following laundry additive compositions were prepared as described in Example 1:

TABLE 8

| | G | H |
|---|---|---|
| boric acid | 1.4 | 1.4 |
| propylene glycol | 4.0 | 4.0 |
| alcohol ethoxylate[1] | 2.0 | 2.0 |
| enzyme | 0.7 | 0.7 |
| xanthan gum | 0.3 | 0.3 |
| Narlex DC-1[2] | 1.0 | 1.0 |
| monoethanolamine | — | 0.4 |
| coconut fatty acid | — | 2.0 |
| deionized water | to 100% | |

[1]a nonionic surfactant supplied by Shell as Neodol 25-9.
[2]a styrene containing acrylic acid copolymer supplied by Alco under the Series H100.

Samples of composition G were prepared as described in Example 1. Samples of composition H were prepared by adding the monoethanolamine and coconut fatty acid to the alcohol ethoxylate (as described in Example 1), adding the monoethanolamine first followed by the fatty acid.

EXAMPLE 7

The fluorescent whitening of the inventive compositions used as laundry additives with a commercial detergent containing fluorescer whitening agents versus the detergent alone was evaluated on soiled cloths. Soil cloths were obtained from EMPA, St. Gallen, Switzerland. EMPA 112 is composed of cocoa, milk and sugar on cotton. EMPA 116 is composed of blood, milk, and indian ink on cotton. EMPA 117 has the same soil as EMPA 116 but it is on polyester/cotton. VCD is composed of vacuum cleaner dust on polyester/cotton. AS-10 is composed of milk powder, ground nut oil, carboxymethylcarubin and small levels of dyes on cotton.

The inventive products were used at a conventional booster level together with the commercial detergent. The composition of the detergent is shown in Table 9. Four of each soil cloth type were washed at the same time and the evaluation was done twice. The results are shown in Table 9. Fluorescer values are calculated using the following equation form reflectance data taken on a Gardner reflectometer with and without an ultraviolet filter.

$$F=0.08+2.61(Z_{wo}-Z_{w})$$

where:

F=fluorescer value 0.08 and 2.61 are instrumental parameters wo=without ultraviolet filter w=with ultraviolet filter $Z=(0.7\alpha-b)L/59.27$ L=reflectance b=yellow-blue value $\alpha$=green-red value Fluorescent whitening of inventive formulations:

TABLE 9

FLUORESCENT WHITENING

| Product | VCD | AS-10 | EMPA 112 | EMPA 116 | EMPA 117 |
|---|---|---|---|---|---|
| detergent alone | 5.39 | 3.94 | 1.13 | 0.43 | 0.04 |
| + formula G | 6.01 | 5.41 | 1.77 | 1.55 | 0.33 |
| + formula H | 5.97 | 5.34 | 1.87 | 1.61 | 0.43 |
| least sig. diff. | 0.26 | 0.26 | 0.16 | 0.16 | 0.16 |

The inventive formulations increase the fluorescent whitening of the detergent significantly. The boost in fluorescent whitening due to the inventive formulations is unexpected because these do not contain fluorescer.

We claim:

1. A method of pretreating stained fabrics before a wash cycle is initiated comprising the steps of:

1) applying an aqueous pretreater composition to a stained fabric, the composition consisting of
(a) about 0.1 to about 20 wt. % of a nonionic surfactant,
(b) less than about 5 wt. % of an anionic soap,
(c) 0.1 to 10% by weight of a copolymer having two monomers, one monomer having a pendant hydrophilic group and one monomer having a pendant hydrophobic group, wherein said copolymer has the following formula:

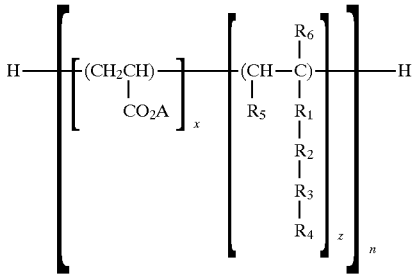

(II)

wherein z is 1;

x:z is less than 20;

n is a number such that said polymer has a molecular weight of 1,000 to 20,000;

$R^1$ represents —CO—O—, —O—, —O—CO—, —$CH_2$—, —CO—NH— or is absent;

$R^2$ represents from 1 to 50 independently selected alkyleneoxy groups or is absent, provided that when $R^3$ is absent and $R^4$ represents hydrogen or contains no more than 4 carbon atoms, then $R^2$ contains an alkyleneoxy group with at least 3 carbon atoms;

$R^3$ represents a phenylene linkage, or is absent;

$R^4$ represents hydrogen or a $C_{1-24}$ alkyl or $C_{2-24}$ alkenyl group, with the provisos that a) when $R^1$ represents —O—CO—, $R^2$ and $R^3$ must be absent and $R^4$ contains at least 5 carbon atoms;

b) when $R^2$ is absent, $R^4$ is not hydrogen and where $R^3$ is absent, then $R^4$ contains at least 5 carbon atoms;

$R^5$ represents hydrogen or a group of formula —COOA;

$R^6$ represents hydrogen or $C_{1-4}$ alkyl; and

A is independently selected from the group consisting of hydrogen, alkali metals, alkaline earth metals, ammonium and amine bases and $C_{1-4}$ alkyl, wherein the monomer units may be in random order, and wherein the molar ratio of the monomer containing the hydrophilic group to the monomer containing the hydrophobic group is less than 20, d) 0 to 10 wt. % of an enzyme, e) 1 to 15% of an enzyme stabilizer, f) one or more optional additives selected from the group consisting of perfumes, dyes, pigments, opacifiers, germicides, optical brighteners, anticorrosional agents, preservatives and mixtures thereof, the amount of each additive being up to about 0.5% by weight, and g) water; and 2) pretreating the stained fabric.

2. A method according to claim 1 wherein the enzyme stabilizer is selected from the group consisting of propylene glycol, ethylene glycol, glycerol, sorbitol, mannitol, glucose and mixtures thereof.

3. A method according to claim 2 wherein the enzyme stabilizer is propylene glycol.

4. A method according to claim 1 wherein the monomers present are acrylic acid and lauryl methacrylate.

5. A method according to claim 1 wherein the molar ratio of the copolymer is less than 17.

6. A method according to claim 5 wherein the molar ratio is less than 10.

7. A method of pretreating stained fabrics before a wash cycle is inititated comprising the steps of a) applying an aqueous pretreater composition to a stained fabric, the composition consisting of (i) about 0.1 to about 5 wt. % of a nonionic surfactant, (ii) less than about 5 wt. % of anionic surfactant, and (iii) 0.1% to 10% by wt. of a copolymer having two monomers, one monomer having a pendant hydrophilic group and one monomer having a pendant hydrophobic group, wherein said copolymer has the following formula:

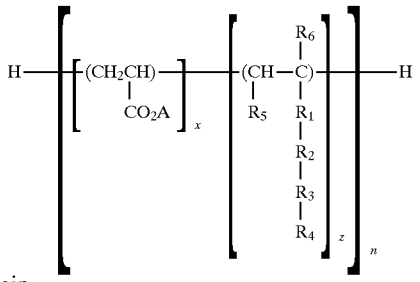

(II)

wherein z is 1;

x:z is less than 20;

n is a number such that said polymer has a molecular weight of 1,000 to 20,000;

$R^1$ represents —CO—O—, —O—, —O—CO—, —$CH_2$—, —CO—NH— or is absent;

$R^2$ represents from 1 to 50 independently selected alkyleneoxy groups or is absent, provided that when $R^3$ is absent and $R^4$ represents hydrogen or contains no more than 4 carbon atoms, then $R^2$ contains an alkyleneoxy group with at least 3 carbon atoms;

$R^3$ represents a phenylene linkage, or is absent;

$R^4$ represents hydrogen or a $C_{1-24}$ alkyl or $C_{2-24}$ alkenyl group, with the provisos that a) when $R^1$ represents —O—CO—, $R^2$ and $R^3$ must be absent and $R^4$ contains at least 5 carbon atoms;

b) when $R^2$ is absent, $R^4$ is not hydrogen and where $R^3$ is absent, then $R^4$ contains at least 5 carbon atoms;

$R^5$ represents hydrogen or a group of formula —COOA;

$R^6$ represents hydrogen or $C_{1-4}$ alky; and

A is independently selected from the group consisting of hydrogen, alkali metals, alkaline earth metals, ammonium and amine bases and $C_{1-4}$ alkyl, wherein the monomer units may be in random order, and wherein the molar ratio of the monomer containing the hydrophilic group to the monomer containing the hydrophobic group is less than 20, optionally:

(iv) up to 10 wt. % of an enzyme, (v) an enzyme stabilizing system selected from the group consisting of propylene glycol, ethylene glycol, glycerol, sorbitol, mannitol, glucose and mixtures thereof, and 2) pretreating the stained fabric.

8. A method according to claim 7 wherein the enzyme stabilizer is propylene glycol.

9. A method according to claim 7 wherein the monomers present are acrylic acid and lauryl methacrylate.

10. A method according to claim 7 wherein the copolymer exhibits a molar ratio of less than 17.

* * * * *